US006954726B2

(12) United States Patent
Brandel et al.

(10) Patent No.: US 6,954,726 B2
(45) Date of Patent: Oct. 11, 2005

(54) METHOD AND DEVICE FOR ESTIMATING THE PITCH OF A SPEECH SIGNAL USING A BINARY SIGNAL

(75) Inventors: Cecilia Brandel, Lund (SE); Henrik Johannisson, Malmö (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 649 days.

(21) Appl. No.: 09/826,729

(22) Filed: Apr. 5, 2001

(65) Prior Publication Data

US 2002/0010576 A1 Jan. 24, 2002

Related U.S. Application Data

(60) Provisional application No. 60/197,044, filed on Apr. 14, 2000.

(30) Foreign Application Priority Data

Apr. 6, 2000 (EP) ..... 00610034

(51) Int. Cl.[7] ..... G10L 19/00
(52) U.S. Cl. ..... 704/217; 704/207
(58) Field of Search ..... 704/207, 217, 704/219, 270.1, 275

(56) References Cited

U.S. PATENT DOCUMENTS

| | | | | |
|---|---|---|---|---|
| 4,015,088 A | * | 3/1977 | Dubnowski et al. | 704/208 |
| 4,081,605 A | * | 3/1978 | Kitawaki et al. | 704/217 |
| 4,783,807 A | * | 11/1988 | Marley | 704/235 |
| 5,121,428 A | * | 6/1992 | Uchiyama et al. | 704/243 |
| 5,784,532 A | * | 7/1998 | McDonough et al. | 704/224 |
| 5,970,441 A | | 10/1999 | Mekuria | 704/207 |
| 6,047,254 A | * | 4/2000 | Ireton et al. | 704/209 |
| 6,377,915 B1 | * | 4/2002 | Sasaki | 704/206 |
| 6,418,407 B1 | * | 7/2002 | Huang et al. | 704/207 |
| 2001/0021906 A1 | * | 9/2001 | Chihara | 704/258 |

FOREIGN PATENT DOCUMENTS

| | | |
|---|---|---|
| EP | 0 538 877 | 4/1993 |
| EP | 0 712 116 | 5/1996 |

OTHER PUBLICATIONS

Quélavoine, R., European Search Report, Application No. EP 00610034, Sep. 4, 2000, pp. 1–3.

Alkulaibi, A., et al., "Fast 3–Level Binary Higher Order Statistics for Simultaneous Voiced/unvoiced and Pitch Detection of a Speech Signal," Signal Processing. European Journal Devoted to the Methods and Applications of Signal Processing, NL, Elsevier Science Publishers B.V Amsterdam, vol. 63, No. 2, Dec. 1, 1997, pp. 133–140.

Krubsack, D., "An Autocorrelation Pitch Detector and Voicing Decision with Confidence Measures Developed for Noise–Corrupted Speech," IEEE Transactions on Signal Processing, vol. 39, No. 2, Feb. 1991.

Quélavoine, R., PCT International Search Report, International Application No. PCT/EP01/03493, Jul. 13, 2001, pp. 1–4.

(Continued)

*Primary Examiner*—Daniel Abebe
(74) *Attorney, Agent, or Firm*—Jenkens & Gilchrist, P.C.

(57) ABSTRACT

A method of estimating the pitch of a speech signal comprises the steps of sampling the speech signal to obtain a series of samples, dividing the series of samples into segments, each segment having a fixed number of consecutive samples, calculating for each segment a conformity function, and detecting peaks in the conformity function. The method provides also an intermediate signal derived from the speech signal, which is set to logical "1" where the intermediate signals exceeds a pre-selected threshold and to logical "0" where the intermediate signal does not exceed the pre-selected threshold, calculating the autocorrelation of the binary signal, and using the distance between peaks in the autocorrelation of the binary signal as an estimate of the pitch. Elaborate operations needed in prior art algorithms is thus avoided. A device conforming to the method is described.

11 Claims, 4 Drawing Sheets

OTHER PUBLICATIONS

Brandel, C. et al., "Speech Enhancement by Speech Rate Conversion," Master of Science Thesis MEE 99–08, University of Karlskrona/Ronneby, pp. 35–57.
Linear Prediction Analysis; Tony Robinson; Speech Vision Robotics Group; 1 Page.
Quick Overview of Linear Predictive Coding (LPC) Analysis; 1 Page.
5.3 Linear Prediction Analysis; 3 Pages.
PLP–Perceptual Linear Predictive Analysis; 4 Pages.
Linear Prediction; 2 Pages.
The Spectral Autocorrelation Applied to the Linear Prediction Residual of Speech for Robust Pitch Detection; E. Chilton et al.; XP–002146623; pp. 358–361.
Performance Comparison of Five Pitch Determination Algorithms on the Linear Prediction Residual of Speech; E.H.S. Chilton et al.; XP 000010751; 5 Pages.
Digital Processing of Speech Signals; Lawrence R. Rabiner et al.; 7 Pages.

* cited by examiner

METHOD AND DEVICE FOR ESTIMATING THE PITCH OF A SPEECH SIGNAL USING A BINARY SIGNAL

CROSS REFERENCES TO RELATED APPLICATIONS

This application for patent claims the benefit of priority from, and hereby incorporates by reference the entire disclosure of, co-pending U.S. Provisional Application for Patent Ser. No. 60/197,044, filed Apr. 14, 2000.

FIELD OF THE INVENTION

The invention relates to a method and device for estimating the pitch of a speech signal, for example, in telephones.

BACKGROUND OF THE INVENTION

In many speech processing systems it is desirable to know the pitch period of the speech. As an example, several speech enhancement algorithms are dependent on having a correct estimate of the pitch period. One field of application where speech processing algorithms are widely used is in mobile telephones.

A well known way of estimating the pitch period is to use the autocorrelation function, or a similar conformity function, on the speech signal. An example of such a method is described in the article D. A. Krubsack, R. J. Niederjohn, "An Autocorrelation Pitch Detector and Voicing Decision with Confidence Measures Developed for Noise-Corrupted Speech", IEEE Transactions on Signal Processing, vol. 39, no. 2, pp. 319–329, February. 1991. The speech signal is divided into segments of 51.2 ms, and the standard short-time autocorrelation function is calculated for each successive speech segment. A peak picking algorithm is applied to the autocorrelation function of each segment. This algorithm starts by choosing the maximum peak (largest value) in the pitch range of 50 to 333 Hz. The period corresponding to this peak is selected as an estimate of the pitch period.

However, such a basic pitch estimation algorithm is not sufficient. In some cases pitch doubling can occur, i.e. the highest peak appears at twice the pitch period. The highest peak may also appear at another multiple of the true pitch period. In these cases a simple selection of the maximum peak will provide a wrong estimate of the pitch period.

The above-mentioned IEEE article also discloses a method of improving the algorithm in these situations. The algorithm checks for peaks at one-half, one-third, one-fourth, one-fifth, and one-sixth of the first estimate of the pitch period. If half of the first estimate is within the pitch range, the maximum value of the autocorrelation within an interval around this half value is located. If this new peak is greater than one-half of the old peak, the new corresponding value replaces the old estimate, thus providing a new estimate which is presumably corrected for the possibility of the pitch period doubling error. This test is performed again to check for double doubling errors (fourfold errors). If this most recent test fails, a similar test is performed for tripling errors of this new estimate. This test checks for pitch period errors of sixfold. If the original test failed, the original estimate is tested (in a similar manner) for tripling errors and errors of fivefold. The final value is used to calculate the pitch estimate.

However, this known algorithm is rather complex and requires a high number of calculations, and these drawbacks make it less usable in real time environments on small digital signal processors as they are used in mobile telephones and similar devices.

Thus, there is need for a method and a device for estimating pitch of a speech signal especially where small digital signal processors are used, such as in mobile telephones and other devices.

It is an object of the invention to provide a method and device of the above-mentioned type which is less complex than the prior art methods, such that the method is suitable for small digital signal processors.

SUMMARY OF THE INVENTION

The method and device of the invention for estimating the pitch of a speech signal are of the type where the speech signal is divided into segments, a conformity function for the signal is calculated for each segment, and peaks in the conformity function are detected. The invention also relates to the use of the method in a mobile telephone. Further, the invention relates to a device adapted to estimate the pitch of a speech signal. According to the invention, the inventive method comprises the steps of providing an intermediate signal derived from the speech signal, converting the intermediate signal to a binary signal, which is set to logical "1" where the intermediate signal exceeds a pre-selected threshold and to logical "0" where the intermediate signal does not exceed the pre-selected threshold, calculating the autocorrelation of the binary signal, and using the distance between peaks in the autocorrelation of the binary signal as an estimate of the pitch.

The invention also resides in a device adapted to estimate pitch of a speech signal, comprising:

- a sampler for sampling the speech signal to obtain a series of samples,
- a divider for dividing the series of samples into segments, each segment having a fixed number of consecutive samples,
- an autocorrelation calculation unit for calculating for each segment a conformity function for the signal, and
- a peak detector for detecting peaks in the conformity function, the device further comprising a programmed unit:
- for providing an intermediate signal derived from the speech signal,
- for converting said intermediate signal to a binary signal, said binary signal being set to logical "1" where the intermediate signal exceeds a pre-selected threshold and to logical "0" where the intermediate signal does not exceed the pre-selected threshold,
- for calculating the autocorrelation of the binary signal, and
- for using the distance between peaks in the autocorrelation of the binary signal as an estimate of the pitch.

The calculation of the autocorrelation of the binary signal takes only a fraction of the computational resources needed for the prior art algorithms. Since there are only values in some positions of the binary signal, the values of the resulting autocorrelation will occur around zero and around the pitch period of the speech signal, and there will only be a few values separated from zero. Thus, the pitch period can easily be estimated to the distance between the values at position zero and the values separated from zero. Elaborate processing and operations needed in prior art algorithms where a specific value has to be found in a vector of numbers is thus avoided.

In one embodiment the intermediate signal may be provided by filtering the speech signal through a filter based on a set of filter parameters estimated by means of linear predictive analysis (LPA). In this way much of the smearing of the original speech signal is removed. Alternatively, the intermediate signal may be provided by calculating the autocorrelation of a signal derived from the speech signal by filtering the speech signal through a filter based on a set of filter parameters estimated by means of linear predictive analysis (LPA). This solution also removes most of the smearing of the original speech signal, and further the possibility of clearer peaks in the intermediate signal is improved.

If the peak corresponding to the distance between the peaks is represented by a number of samples, the best estimate is achieved when the sample having the maximum amplitude of said conformity function is selected as the estimate of the pitch.

Expediently, in an embodiment, the inventive method is used in a mobile telephone, which is a typical example of a device having only limited computational resources.

As mentioned, the invention further relates to a device adapted to estimate the pitch of a speech signal. The device comprises means for sampling the speech signal to obtain a series of samples, means for dividing the series of samples into segments, each segment having a fixed number of consecutive samples, means for calculating for each segment a conformity function for the signal, and means for detecting peaks in the conformity function.

The device further comprises means for providing an intermediate signal derived from the speech signal, means for converting said intermediate signal to a binary signal, said binary signal being set to logical "1" where the intermediate signal exceeds a pre-selected threshold and to logical "0" where the intermediate signal does not exceed the pre-selected threshold, means for calculating the autocorrelation of the binary signal, and means for using the distance between peaks in the autocorrelation of the binary signal as an estimate of the pitch; a device less complex than prior art devices is achieved, which also avoids the pitch halving situation.

In one embodiment the device may be adapted to provide the intermediate signal by filtering the speech signal through a filter based on a set of filter parameters estimated by means of linear predictive analysis (LPA). In this way much of the smearing of the original speech signal is removed.

Alternatively, the device may be adapted to provide the intermediate signal by calculating the autocorrelation of a signal derived from the speech signal by filtering the speech signal through a filter based on a set of filter parameters estimated by means of linear predictive analysis (LPA). This solution also removes most of the smearing of the original speech signal, and further the possibility of clearer peaks in the intermediate signal is improved.

If the peak corresponding to the distance between the peaks is represented by a number of samples, the best estimate is achieved when the device is adapted to select the sample having the maximum amplitude of said conformity function as the estimate of the pitch.

In an expedient embodiment of the invention, the device is a mobile telephone, which is a typical example of a device having only limited computational resources.

In another embodiment the device is an integrated circuit which can be used in different types of equipment.

BRIEF DESCRIPTION OF THE DRAWING

The invention will now be described more fully below with reference to the drawing, in which.

DETAILED DESCRIPTION

Figure 1:
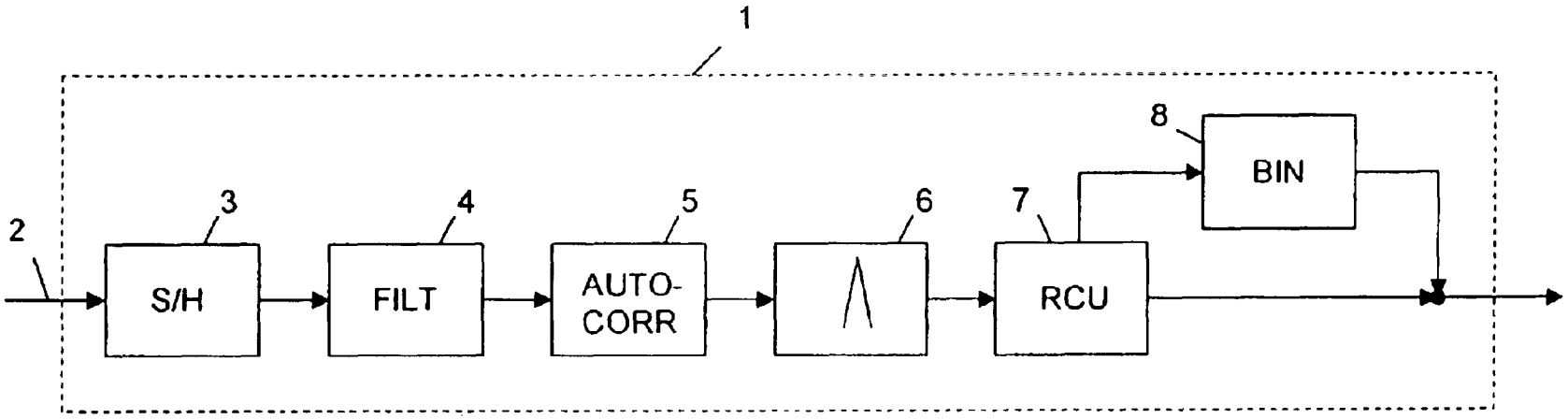
FIG. 1 shows a block diagram of a pitch detector according to an embodiment of the invention.

FIG. 1 shows a block diagram of an example of a pitch detector 1 according to the invention. A speech signal 2 is sampled with a sampling rate of 8 kHz in the sampling circuit 3 and the samples are divided into segments or frames of 160 consecutive samples. Thus, each segment corresponds to 20 ms of the speech signal.

This is the sampling and segmentation normally used for the speech processing in a standard mobile telephone.

Each segment of 160 samples is then processed in a filter 4, which will be described in further detail below.

First, however, the nature of speech signals will be discussed briefly. In a classical approach a speech signal is modelled as an output of a slowly time-varying linear filter. The filter is either excited by a quasi-periodic sequence of pulses or random noise depending on whether a voiced or an unvoiced sound is to be created. It is important to note the definition of "voiced sound" in the context of this invention. The pulse train which creates "voiced sounds" as used herein, is produced by pressing air out of the lungs through the vibrating vocal cords. The period of time between the pulses is called the pitch period and is of great importance for the singularity of the speech. On the other hand, unvoiced sounds are generated by forming a constriction in the vocal tract and produce turbulence by forcing air through the constriction at a high velocity. This description deals with the detection of the pitch period of voiced sounds, and thus unvoiced sounds will not be further considered.

As speech is a varying signal also, the filter has to be time-varying. However, the properties of a speech signal change relatively slowly with time. It is reasonable to believe that the general properties of speech remain fixed for periods of 10–20 ms. This has led to the basic principle that if short segments of the speech signal are considered, each segment can effectively be modelled as having been generated by exciting a linear time-invariant system during that period of time. The effect of the filter can be seen as caused by the vocal tract, the tongue, the mouth and the lips.

Figure 2:
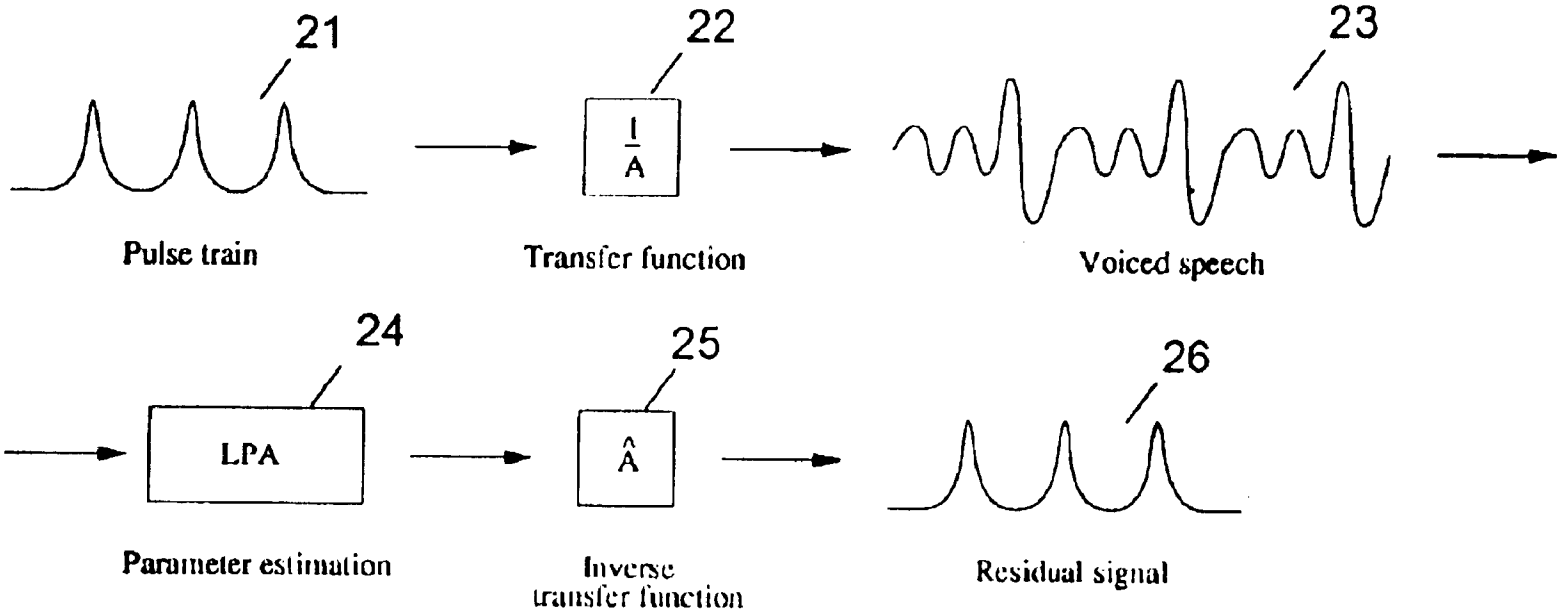
FIG. 2 shows the generation of a residual signal.

As mentioned, voiced speech can be interpreted as the output signal from a linear filter driven by an excitation signal. This is shown in the upper part of FIG. 2 in which the pulse train 21 is processed by the filter 22 to produce the voiced speech signal 23. A good signal for the detection of the pitch period is obtained if the excitation signal can be extracted from the speech. By estimating the filter parameters A in the block 24 and then filtering the speech through an inverse filter 25 based on the estimated filter parameters, a signal 26 similar to the excitation signal can be obtained. This signal is called the residual signal. This process is shown in the lower part of FIG. 2. The blocks 24 and 25 are included in the filter 4 in FIG. 1.

The estimation of the filter parameters is based on an all-pole modelling which is performed by means of the method called linear predictive analysis (LPA). The name comes from the fact that the method is equivalent with linear prediction. This method is well known in the art and will not be described in further detail here.

The estimation of the pitch is based on the autocorrelation of the residual signal, which is obtained as described above.

Figure 3A:
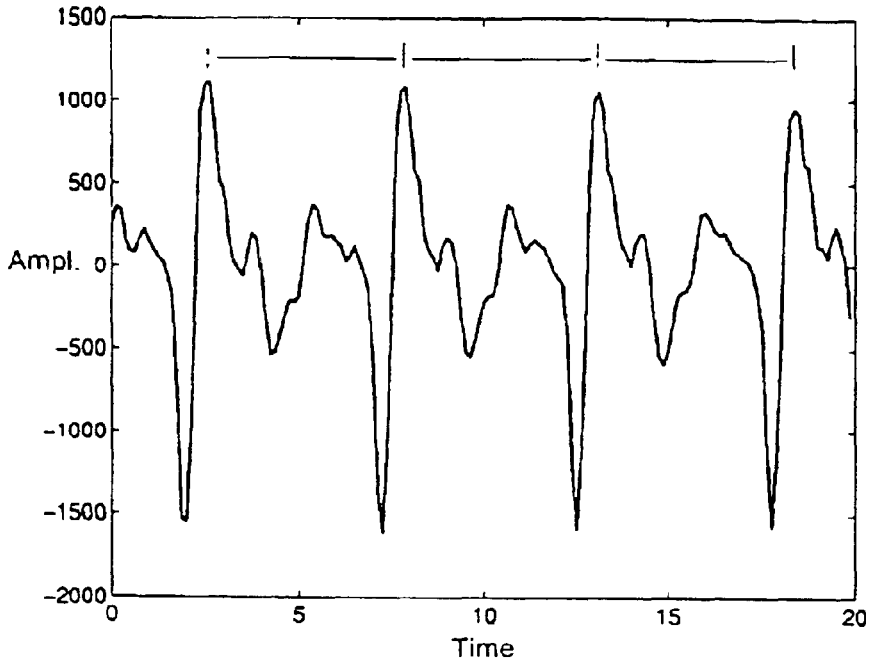
FIG. 3*a* shows a 20 ms segment of a voiced speech signal.
Figure 3B:
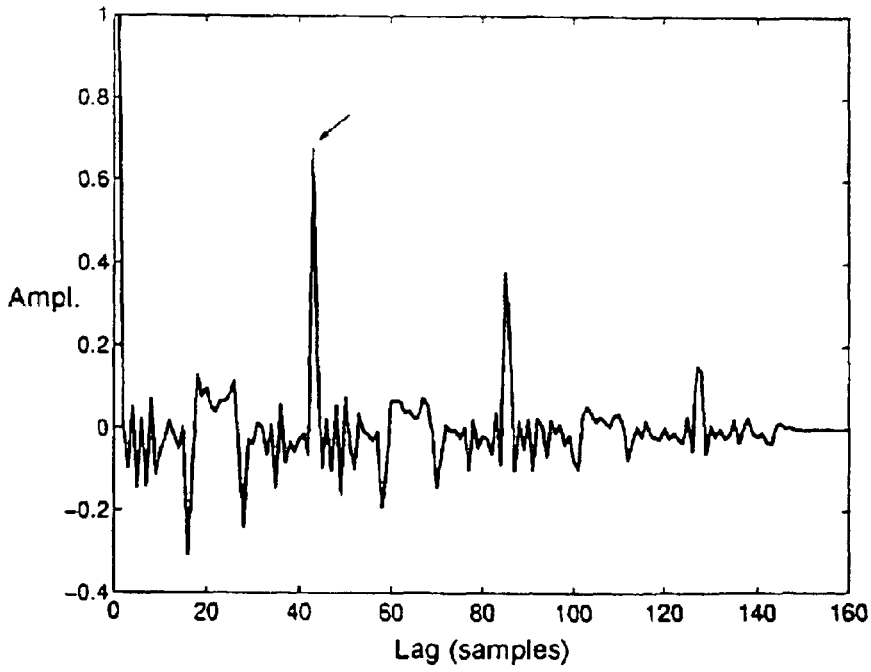
FIG. 3*b* shows the autocorrelation function of a residual signal corresponding to the segment of FIG. 3*a*.

Thus, the output signal from the filter 4 is taken to an autocorrelation calculation unit 5. FIG. 3*a* shows an example of a 20 ms segment of a voiced speech signal and FIG. 3*b* the corresponding autocorrelation function of the residual signal. It will seen from FIG. 3*a* that the actual pitch period is about 5.25 ms corresponding to 42 samples, and thus the pitch estimation should end up with this value.

Thus, the autocorrelation function may be calculated directly of the speech signal instead of the residual signal, or other conformity functions may be used instead of the autocorrelation function. As an example, a cross correlation could be calculated between the speech signal and the residual signal.

Further, different sampling rates and sizes of the segments may be used.

The next step in the estimation of the pitch is to apply a peak picking algorithm to the autocorrelation function provided by the unit 5. This is done in the peak detector 6 which identifies the maximum peak (i.e. the largest value) in the autocorrelation function. The index value, i.e. the sample number or the lag, of the maximum peak is then used as a preliminary estimate of the pitch period. In the case shown in FIG. 3*b* it will be seen that the maximum peak is actually located at a lag of 42 samples. The search of the maximum peak is only performed in the range where a pitch period is likely to be located. In this case the range is set to 60–333 Hz.

Figure 4:
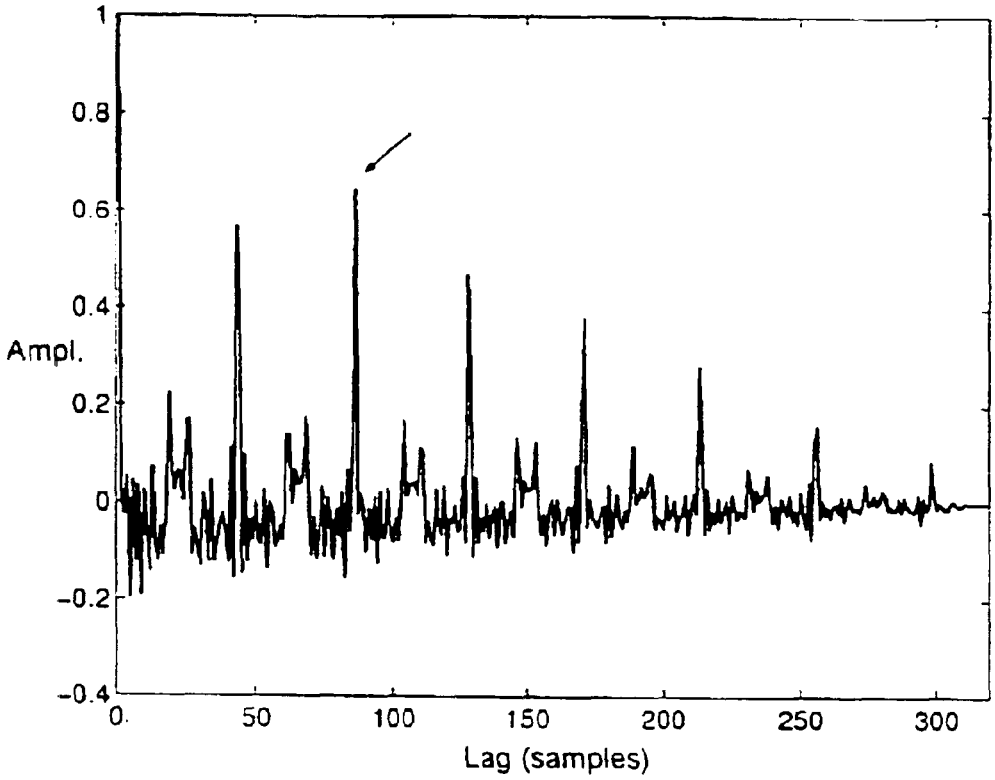
FIG. 4 shows an example of an autocorrelation function where pitch doubling could arise.

However, this basic pitch estimation algorithm is not always sufficient. In some cases pitch doubling may occur, i.e. due to distortion, the peak in the autocorrelation function corresponding to the true pitch period is not the highest peak, but instead the highest peak appears at twice the pitch period. The highest peak could also appear at other multiples of the actual pitch period (pitch tripling, etc.) although this occurs relatively rarely. A typical example where pitch doubling would arise is shown in FIG. 4, which again shows the autocorrelation function of the residual signal. Here, too, the correct pitch period would be 42 around samples, but the peak at twice the pitch period, i.e. around 84 samples, is actually higher than the one at 42 samples. The basic pitch estimation algorithm would therefore estimate the pitch period to 84 samples and pitch doubling would thus occur.

To avoid the problem of pitch doubling, the pitch detection algorithm is therefore improved as described below.

After the preliminary pitch estimate has been determined, it is checked in the risk check unit 7 whether there is any risk of pitch doubling. All peaks with a peak value higher than 75% of the maximum peak are detected and the further processing depends on the result of this detection. If only one peak is detected, i.e. the original maximum peak, there is no need to perform a process to avoid pitch doubling. In this situation the preliminary pitch estimate is used as the final pitch estimate. If, however, more than one peak is detected, there is a risk of pitch doubling and a further algorithm must be performed to ensure that the correct peak is selected as the pitch estimate. This is performed in the unit 8.

To identify the peak corresponding to the actual pitch period a modified signal is provided based on the location of the peaks in the autocorrelation of the residual signal. This modified signal, referred to as binary signal, consists of only ones and zeros. The binary signal is set to one where the high peaks are found in the autocorrelation sequence. All other values are set to zero, and then the autocorrelation of the binary signal is calculated. Since there are only values in some positions in the binary signal, the resulting autocorrelation will only have a few values separated from zero, and these values will occur around the pitch period of the signal. The pitch period is estimated by observing the distance between the indexes of the values around zero and those separated from zero. If the group of values separated from zero contains only a single value, it is selected as the estimate of the pitch period. If there is more than one value in the group, the one with the highest amplitude in the autocorrelation of the residual signal is chosen.

Sometimes cases may arise where the peak at lag zero is the only peak present. This situation will occur when a peak has been split on two samples and there are no other high peaks in the autocorrelation of the residual signal. In this case the preliminary pitch estimate is chosen as the final pitch estimate.

This algorithm is very simple, and therefore it is well suited in e.g. mobile telephones in which the computational resources are severely limited, and a demand for a low-complexity algorithm is thus placed upon the system. The algorithm may also be implemented in an integrated circuit which may then be used in other types of equipment.

Equivalents

Although preferred embodiments of the method and apparatus of the present invention have been illustrated in the accompanying drawings and described in the foregoing description, it will be understood that the invention is not limited to the embodiments disclosed, but is capable of numerous rearrangements, modifications, equivalents and substitutions without departing from the scope of the invention as set forth in the appended claims.

What is claimed is:

1. A method of estimating pitch in a speech signal, the method comprising the steps of:

sampling the speech signal to obtain a series of samples, dividing the series of samples into segments, each segment having a fixed number of consecutive samples, calculating for each segment an autocorrelation function for the signal, providing an intermediate signal derived from the autocorrelation function of the speech signal, converting said intermediate signal to a binary signal, said binary signal being set to logical "1" where the intermediate signal exceeds a pre-selected threshold and to logical "0" where the intermediate signal does not exceed the pre-selected threshold, calculating an autocorrelation function of the binary signal, detecting peaks in the autocorrelation function of the binary signal, and using distance between peaks in the autocorrelation function of the binary signal as an estimate of the pitch.

2. The method according to claim 1, wherein the speech signal is filtered through a filter based on a set of filter parameters estimated by using linear predictive analysis (LPA).

3. The method according to claim 1, further comprising the step of:

selecting, if the peak corresponding to the distance between the peaks is represented by a number of samples, the sample having the maximum amplitude of said autocorrelation function as the estimate of the pitch.

4. Use of the method according to claim 1 in a mobile telephone.

5. The method of claim 1, wherein:

the provided intermediate signal is derived from the autocorrelation function of the speech signal, and the binary signal is set to logical "1" where a peak value in an autocorrelation sequence of the intermediate signal exceeds a pre-selected threshold and to logical "0" where a peak value of an autocorrelation sequence of the intermediate signal does not exceed the pre-selected threshold.

6. A device adapted to estimate pitch of a speech signal, comprising:

a sampler for sampling the speech signal to obtain a series of samples, a divider for dividing the series of samples into segments, each segment having a fixed number of consecutive samples, an autocorrelation calculation unit for calculating for each segment an autocorrelation function for the signal, and a programmed unit:

for providing an intermediate signal derived from the autocorrelation function of the speech signal, for converting said intermediate signal to a binary signal, said binary signal being set to logical "1" where the intermediate signal exceeds a pre-selected threshold and to logical "1" where the intermediate signal does not exceed the pre-selected threshold, for calculating the autocorrelation of the binary signal, for detecting peaks in the autocorrelation function of the binary signal, and for using distance between peaks in the autocorrelation function of the binary signal as an estimate of the pitch.

7. The device according to claim 6, which includes a filter which is adapted to filter the speech signal through the filter based on a set of filter parameters estimated by means of linear predictive analysis (LFA).

8. The device according to claim 6, which is further adapted to select, if a peak corresponding to the distance between the peaks is represented by a number of samples, the sample having the maximum amplitude of said autocorrelation function as the estimate of the pitch.

9. The device according to claim 6, wherein the device is a mobile telephone.

10. The device according to claim 6, wherein the device is an integrated circuit.

11. The device of claim 6, wherein:

the provided intermediate signal is derived from the autocorrelation function of the speech signal, and the binary signal is set to logical "1" where a peak value in an autocorrelation sequence of the intermediate signal exceeds a pre-selected threshold and to logical "0" where a peak value of an autocorrelation sequence of the intermediate signal does not exceed the pre-selected threshold.

* * * * *